US005233339A

United States Patent [19]

Newman et al.

[11] Patent Number: 5,233,339

[45] Date of Patent: Aug. 3, 1993

[54] CIRCUIT FOR CREATING A VARIABLE LCD CONTRAST VOLTAGE UNDER COMPUTER CONTROL

[75] Inventors: Lee A. Newman, Dayton; Dusty L. Lutz, Miamisburg; Theodore Heske, III, Centerville, all of Ohio

[73] Assignee: NCR Corporation, Dayton, Ohio

[21] Appl. No.: 769,305

[22] Filed: Oct. 1, 1991

[51] Int. Cl.[5] ..... G09G 3/36

[52] U.S. Cl. ..... 340/784; 340/793; 340/813

[58] Field of Search ..... 340/767, 784 B, 784 F, 340/793, 813; 358/30

[56] References Cited

U.S. PATENT DOCUMENTS 4,390,874 1/1983 Woodside et al. ..... 340/784 X 4,727,414 2/1988 Ranf et al. ..... 358/30

4,848,876 7/1989 Yamakawa ..... 340/813

*Primary Examiner*—Ulysses Weldon

*Assistant Examiner*—Regina Liang

*Attorney, Agent, or Firm*—Elmer Wargo

[57] ABSTRACT

A method and circuit for controlling the contrast of a liquid crystal display (LCD). The circuit includes a switching regulator circuit which generates a negative voltage at the output thereof, with the switching regulator circuit having a feedback node therein and also having a voltage regulator with a control input therein. An injected current coupled to the feedback node and the control input to the voltage regulator is used to provide a changed negative voltage at the output of the regulator circuit. Control values stored in the memory of a controller are used to select the injected current. The changed negative voltage at the output of the regulator circuit is used to control the contrast of the LCD.

6 Claims, 3 Drawing Sheets

VLCD
34
33
+C6 .1µf
+C5 10 35V
+C4 10 35V
+C3 10 35V
30
R1 6.65K 1%
R20 4700
R18 402 1%
R19 4700
R25 10
R24 10
R23 10
R22 10
R21 10
32
L1 1mH
R 26 1000
C2 .1µf
FEEDBACK
35
+12V
CR1 IN4148
10-1
VCC
CLS
BD
BASE
CD
ED
AND
GND
CI
INH
FCNT
SUB
CRT
N/C
C1 220pf

CIRCUIT FOR CREATING A VARIABLE LCD CONTRAST VOLTAGE UNDER COMPUTER CONTROL

BACKGROUND OF THE INVENTION (1) Field of the Invention.

This invention relates to a method and apparatus for controlling the contrast of a Liquid Crystal Display (LCD) through using computer control.

(2) Background Information.

A negative voltage is generally required to control the contrast of an LCD, with the contrast being very dependent upon the particular operator viewing the display. There is a certain range of contrast which is acceptable to most operators; however, there is a smaller range which is set according to the preference of individual operators.

In one application, the variation in negative voltage being supplied to the LCD to change the contrast may vary from −14.5 Volts to −20.1 Volts. One of the prior art methods of providing for a change in negative voltage for controlling the contrast of the LCD is to provide, initially, a constant or controlled negative voltage and then, vary the controlled negative voltage through using a potentiometer. When the LCD requires a large amount of power to operate it, using a potentiometer tends to waste energy.

Another problem is that the use of a potentiometer, as described above, requires that there be some external control for adjusting the contrast of the LCD.

SUMMARY OF THE INVENTION

An object of this invention is to provide a method and apparatus for controlling the contrast of an LCD through using computer control.

Another object is to provide a method and apparatus for controlling the contrast of an LCD without using a fixed negative voltage and varying the fixed negative voltage.

Another object of this invention is to provide a low cost method and circuit for providing a variety of negative voltages which can be used in controlling the contrast of an LCD.

In a first aspect of this invention, there is provided a computer controlled method of controlling the contrast of an LCD comprising the steps of:

(a) using an injected current controlled by a value stored in the computer to produce one of several negative voltages; and (b) using said one of several negative voltages to control the contrast of the LCD.

In a second aspect of this invention, there is provided an apparatus for controlling the contrast of an LCD comprising:

a switching regulator having an output voltage for connection to the LCD and also having a feedback node therein; and means for changing a control current fed to said feedback node to vary said output voltage.

The above objects and certain features to be described will be more readily understood in connection with the following description, claims, and drawing.

DESCRIPTION OF THE PREFERRED EMBODIMENT

Figure 1:
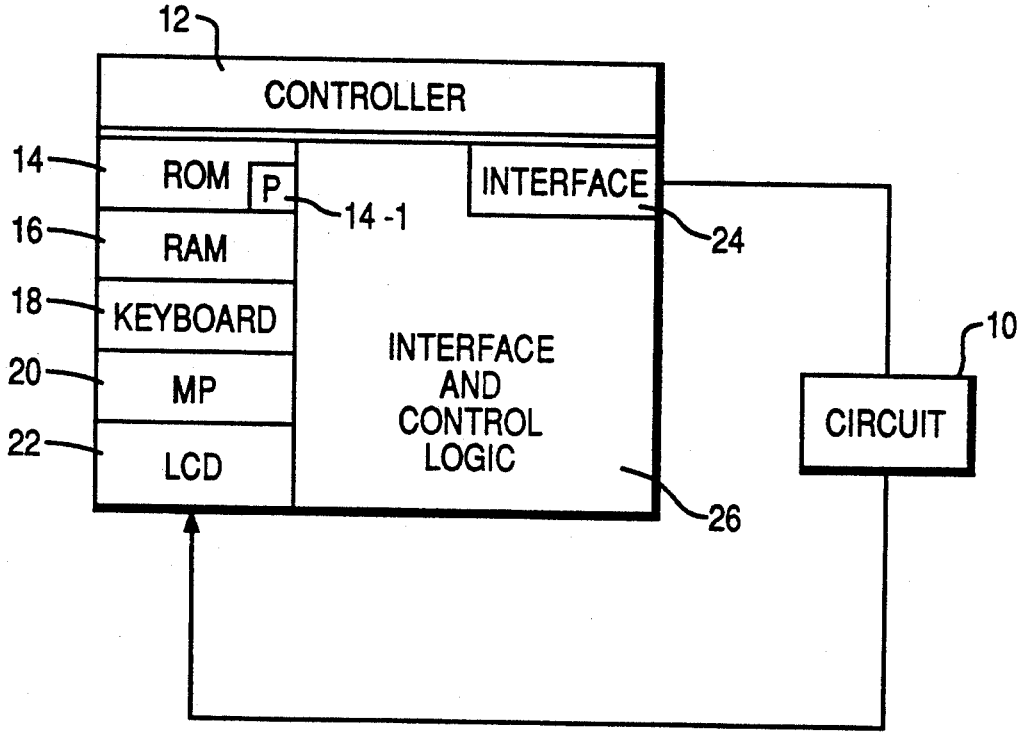
FIG. 1 is a general schematic circuit, in block form, showing how a circuit for controlling the contrast of an LCD may be coupled to a controller.

FIG. 1 shows how a 10, made according to a preferred embodiment of this invention, is coupled to a computer or 12. The controller 12 is conventional, it includes a ROM 14, a RAM 16, a keyboard (KB) 18, a microprocessor (MP) 20, a liquid crystal display (LCD) 22, an interface 24 for coupling the controller 12 to the circuit 10, and interface and control logic 26 for coupling the various elements mentioned to one another. The form of the controller 12 shown is used to show the interrelationships among the various elements mentioned, while the actual form of the controller 12 is different from that shown.

The circuit 10 is used for creating a variable LCD contrast voltage for the LCD 22, with this LCD 22 being under the con of the controller 12. The circuit 10 is shown in more detail in FIGS. 2A and 2B, with circuit portion 10-1 shown in FIG. 2B and circuit portion 10-2 shown in FIG. 2A. As previously stated, some of the prior art circuits for providing a variety of negative voltages to change the contrast of an LCD included a switching regulator. The switching regulator produce a constant or fixed negative output voltage which reduced to provide a variety of negative voltages to control the contrast of the LCD. The changes in the fixed negative output voltage were effected by a potentiometer, a pass transistor, or a voltage divider or similar technique, for example.

Figure 2A:
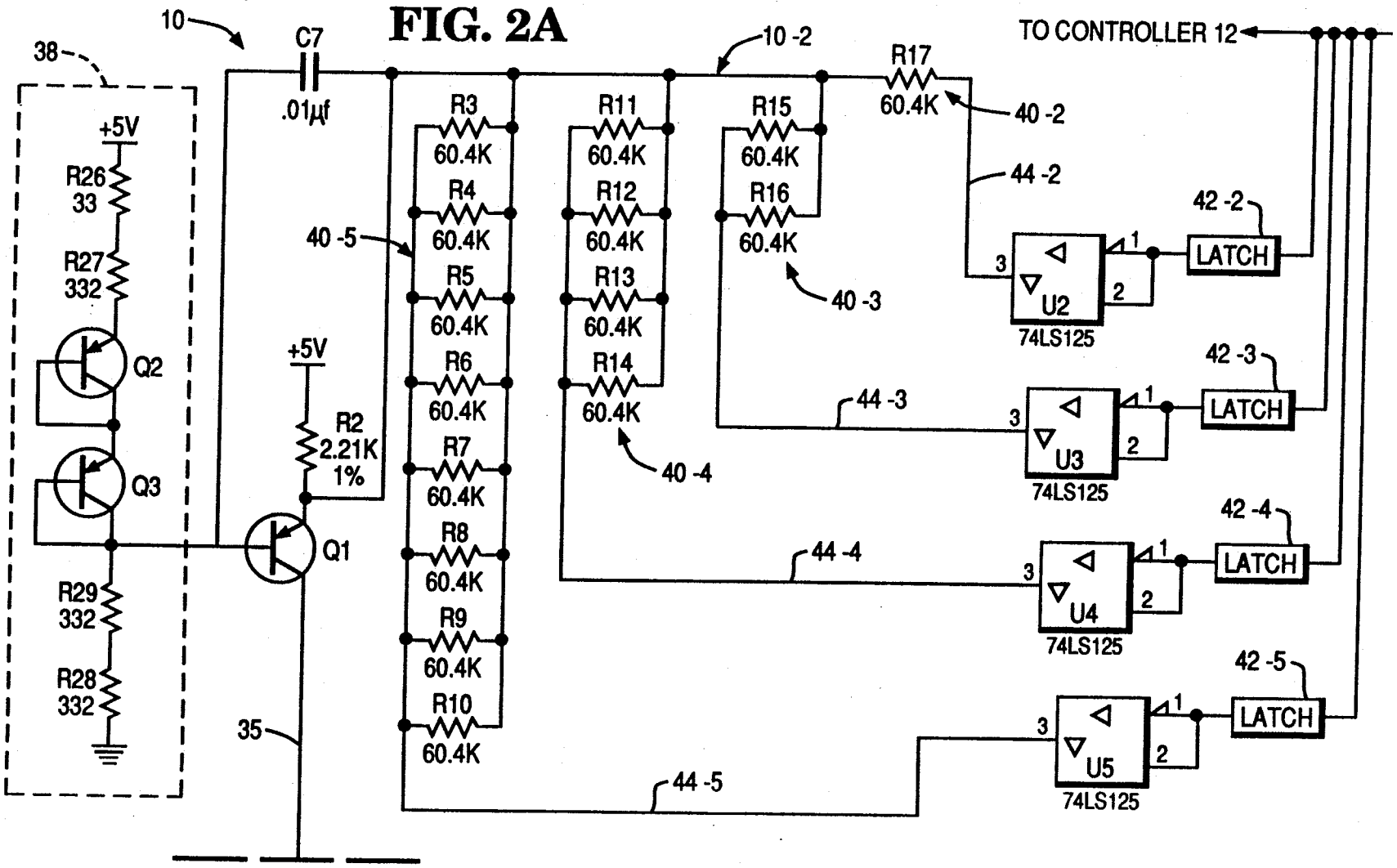
FIGS. 2A and 2B, taken together, show more details of the circuit shown in FIG. 1.
Figure 2B:
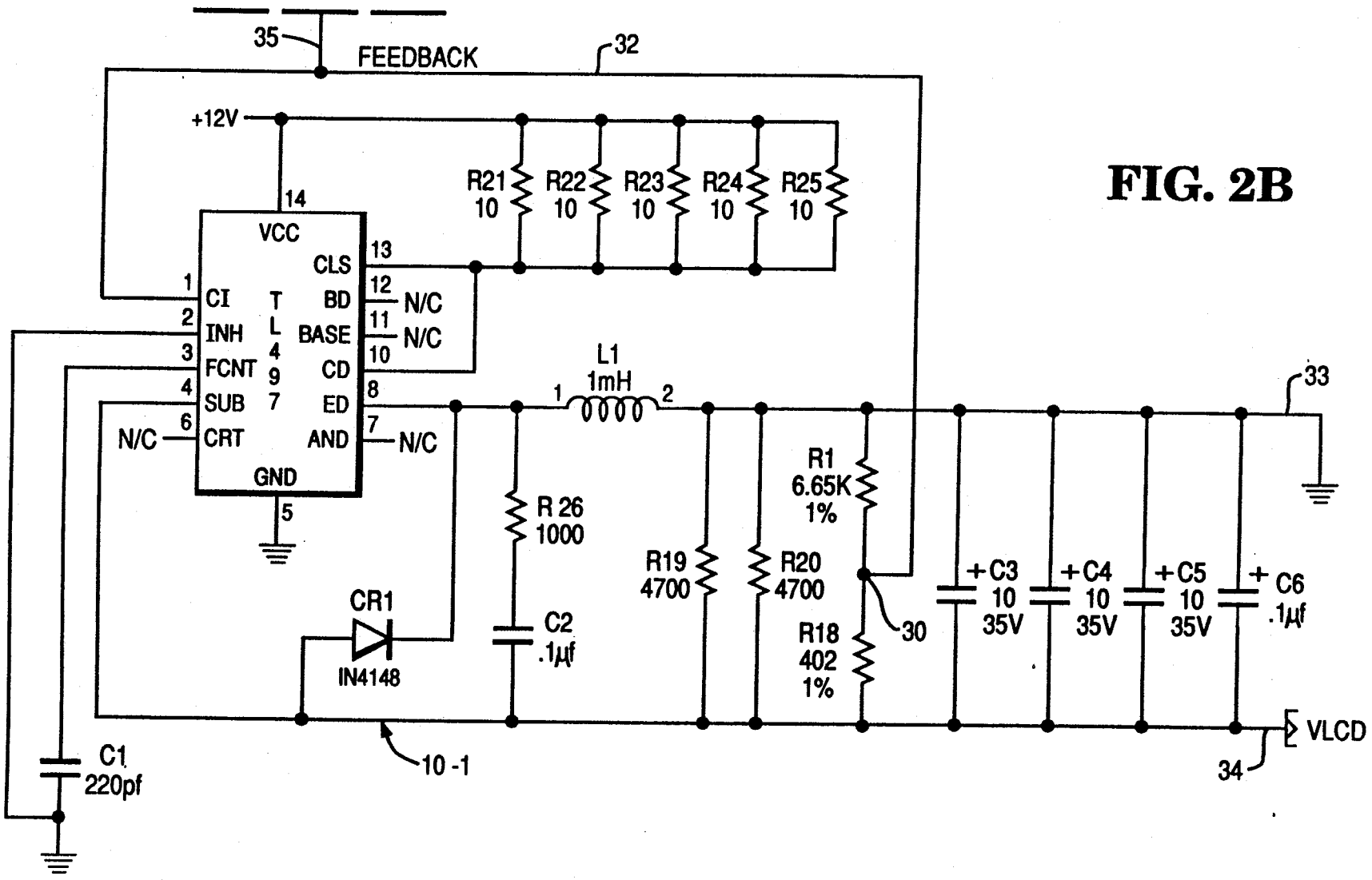

The present invention provides a computer controlled method of controlling the contrast of an LCD, with the basic steps including:

(a) using an injected current controlled by a value stored in the computer to produce one of several negative voltages; and (b) using the negative voltage produced to control the contrast of the LCD. FIGS. 2A and 2B provide the circuit 10 to show how this technique is effected.

The circuit portion 10-1 of the circuit 10 shown in FIG. 2B is essentially a voltage regulator circuit which includes a voltage regulator chip U7 such as IC chip TL497 as shown. The pertinent pin connections for the regulator chip U7 are shown on FIG. 2B. Pin 1 of chip U7 is coupled to an Op Amp (not shown) located inside of the chip U7, with the Op Amp functioning as a sensor of the voltage to keep the current drawn by pin 1 the same. In other words, even though the voltage coming into pin 1 of chip U7 may change, the current drawn by pin 1 will always be the same, or, at worst, it varies by a very small amount.

The circuit portion 10-1 also includes a feedback node 30 shown in FIG. 2B which is coupled to pin 1 of the voltage regulator chip U7 by a conductor 32. The output of the circuit 10 is shown as VLCD which is coupled to conductor 34. In the embodiment described, the output VLCD varies between −14.5 Volts to −20.1 Volts, with this output being shown graphically below ground 33.

The circuit portion 10-1 has certain elements which function in their usual capacity for such a circuit. In this regard, the capacitor C1 determines the "on" time of the associated pass transistor (not shown) which is located within the chip U7. The diode CR1 is used to make the circuit portion 10-1 a negative voltage circuit instead of a positive one. The resistors R19 and R20 are used to provide a load for the circuit portion 10-1. The inductor L1 tends to smooth the voltage along with the capacitors C3, C4, C5, and C6. Resistor R26 and capacitor C2 are used as a snubber. The resistors R21 through R25 which are connected in parallel could be replaced by a single 2 ohm resistor in the embodiment described; however, 5 resistors were used to facilitate the fabrication of the board on which the circuit portion 10-1 was manufactured.

In prior art circuits, the resistors, like R1 and R18, (shown in FIG. 2B) are fixed for a particular application and the voltage at the connection or node between these two resistors is used as a feedback voltage and fed into pin 1 of the voltage regulator chip U7. The chip U7 then uses the feedback voltage to generate a constant negative voltage at the output of the associated circuit, and this output is varied by a potentiometer, for example, as discussed previously herein. In general, the chip U7 expects the voltage at pin 1 to be 1.2 Volts less than the output voltage of the circuit, and it reacts in a manner to produce this outcome.

As previously stated, the present invention uses an injected current controlled by a value stored in the controller 12. The injected current is fed into the feedback node 30 over conductors 35 and 32 as shown in FIG. 2B, and the resulting voltage is fed into pin 1 of the voltage regulator chip U7. The injected current is obtained from the circuit portion 10-2 shown in FIG. 2A.

The circuit portion 10-2 includes a control transistor Q1 which controls the current being fed into the feedback node 30 shown in FIG. 2B. Transistors Q2 and Q3, and resistors R26–R29, which are shown in the dashed rectangle 38, provide a conventional, temperature compensating circuit for the control transistor Q1 in that this circuit provides a constant voltage at the base of control transistor Q1 and consequently, a constant voltage at the emitter thereof.

The circuit 10-2 also includes groups of resistors which are used to vary the output voltage of the circuit 10 at VLCD. The groups of resistors are shown as 40-2, 40-3, 40-4, and 40-5, with these groups including resistors R3-R17, and with each of these resistors having the same value. In the embodiment described, group 40-2 includes only resistor R17, having a value of 60.4K ohms. Group 40-3 provides half the resistance of group 40-2; group 40-4 provides half the resistance of group 40-3; and correspondingly, group 40-5 provides half the resistance of group 40-4. Using a resistor having the same value in the groups 40-2 through 40-5 facilitates the manufacturing of the circuit 10 and also facilitates showing the relationship among the several groups of resistors. The groups of resistors 40-2 through 40-5 are generally not coupled into the circuit 10, except as will be described hereinafter.

When the groups 40-2 through 40-5 are not coupled in the circuit 10, a constant current is provided through the resistor R2 to the emitter of transistor Q1 and through the collector thereof. The current from the collector of transistor Q1 is not absorbed by pin 1 of the voltage regulator chip U7 and consequently, it flows through the feedback node 30 and the resistors R1 and R18. The amount of current flowing through these resistors R1 and R18 is proportional to their associated resistances. In the example being given, because the current through the collector of transistor Q1 is constant, the voltage appearing at VLCD is constant and about −14.5 Volts. This voltage provides the usual contrast for the LCD 22.

By varying the current flowing through the collector of transistor Q1, the voltage appearing at VLCD can also be varied. When any of the groups of resistors 40-3 through 40-4 is coupled into the circuit 10 (by grounding one end of the associated resistor group), the current entering the emitter of transistor Q1 is reduced. When the current entering the emitter of transistor Q1 is reduced, the current injected or flowing into the feedback node 30 is reduced, causing the voltage across the resistors R1 and R18 to change. The voltage regulator chip U7 will automatically change its threshold to keep the feedback node 30 at 1.2 Volts from VLCD, resulting in a modified value for VLCD.

By selecting the appropriate values of resistance for the groups of resistors 40-2 through 40-5, the voltage across resistor R1 at the feedback node (FIG. 2B) can be modified by the full amount of the injected current. Changing the centerpoint of the output ranges of voltage at VLCD can be achieved by varying resistor R1 and/or resistor R2. If the range of output voltage VLCD is to be increased by more than a small amount, it may be necessary to reduce the value of resistor R18 and modify R1 correspondingly.

The circuit portion 10-2 shown in FIG. 2A provides a means for providing a constant, controllable current to the feedback node 30 (FIG. 2B), with the controllable current being changed in steps, for example, under the control of the controller 12. As previously stated, groups of resistors 40-2, 40-3, 40-4, and 40-5 are normally not coupled into the circuit portion 10-2 until they are actively coupled or grounded, respectively, through associated three state gates U2, U3, U4, and U5 shown in FIG. 2A.

The three state gates U5, U4, U3, and U2 are standard gates, and they have their associated pins 1 and 2 tied together and coupled, respectively, through associated latches 42-5, 42-4, 42-3, and 42-2 to the controller 12. The three state gates U5, U4, U3, and U2 have their associated pins 3 coupled to one end of the groups of resistors 40-5, 40-4, 40-3, and 40-2 via associated conductors 44-5, 44-4, 44-3, and 44-2. Pin 1 of three state gate U2, for example, is the control pin, and pin 2 could have been coupled to ground; instead, it is simply connected to pin 1.

In operation, when the signal on pin 1 is at a high level, pin 3 of the associated three state gate, like U2 (FIG. 2A), would be effectively locked out of the circuit 10. When the signal on pin 1 is at a low level, pin 3 of the associated three state gate, like U2, falls to a low level, coupling the associated group of resistors, like 40-2, to ground. Pin 1 is the controlling pin for the three state gates mentioned. When a group of resistors, like 40-2, is coupled to ground, the resistance of the group is effectively added in parallel to the resistance of resistor R2 to change (lessen) the injected current being fed into the feedback node 30, as previously discussed. Another way of stating this is that the Thevenin equivalent of the circuit portion 10-2 is as though the groups of resistors( like 44-5 and 44-4, for example, are in parallel with the control resistor R2 when the ends of these groups of resistors are grounded through the associated selection means including the three state gates, like U5 and U4, for example.

The various groups of resistors 40-2 through 40-5 may be added in parallel into the circuit 10 in various combinations to vary the negative output voltage at VLCD to thereby vary the contrast of the LCD 22. A program (P) 14-1, shown in FIG. 1, for changing the contrast of the LCD may be stored in the ROM 14 or downloaded into the RAM 16 as is customarily done. The program 14-1 is initiated by actuating an appropriate key on the keyboard 18. Once initiated, the program will indicate an instruction on the LCD 22 as to how to either increase the contrast or decrease it. This can be effected by actuating an "Up" arrow key for increasing the contrast voltage, or by actuating a "Down" arrow key for decreasing the contrast voltage. Actuating an Up arrow key or a Down arrow key may select an appropriate value or signal from the controller 12 to control the three state gates, like U2, for example. In the embodiment described, the group of resistors 40-5 is coupled into the circuit 10 on power up. This provides somewhat of a starting point for varying the contrast in either direction. For example, actuating the Up arrow key may add an additional group of resistors, like 40-4, into the circuit 10 to increase the negative voltage at VLCD closer to the −20.1 volts in the embodiment described. Adding a group of resistors in the circuit 10 means that a signal is sent from the controller 12 to the associated latch, like 40-4, to condition the three state gate, like U4, to place conductor 44-4 at ground level. After start up, actuating the Down arrow key on the keyboard 18 may lower the contrast voltage by taking the group of resistors 40-5 (which are normally coupled into the circuit 10 on start up) out of the circuit 10.

As previously stated, this invention produces a variable output voltage at VLCD which is effected without the voltage dropping requirement of prior fixed switching regulator designs. As such, the circuit 10 consumes less power from the switching regulator than a comparable design using a voltage dropping element. While this invention is discussed in relation to controlling an LCD, the stepped voltages generated thereby may be used to control other utilization devices.

What is claimed is:

1. An apparatus comprising a liquid crystal display (LCD); and a circuit for controlling a contrast of said LCD comprising:

a controller including a memory for storing values to control the contrast of said LCD and also including a program for executing instructions associated with controlling the contrast of said LCD;

a switching regulator having an output voltage for connection to the LCD and also having a feedback node therein;

a first circuit portion for providing a fixed current to said feedback node; and a second circuit portion for changing said fixed current to said feedback node in response to at least one of said values selected via said program;

said first circuit portion including a first control resistor, and also including a plurality of groups of resistors, with each group of resistors having one of said values associated therewith; and each said group of resistors being effectively coupled in parallel to said first control resistor in response to the selection of the associated value via said program for changing the current to said feedback node.

2. An apparatus comprising:

a liquid crystal display (LCD); and a circuit for controlling a contrast of said LCD comprising:

a controller including a memory for storing values to control the contrast of said LCD and also including a program for executing instructions associated with controlling the contrast of said LCD;

a switching regulator having an output voltage for connection to the LCD and also having a feedback node therein;

a first circuit portion including a control resistor and a control transistor for providing a fixed current to said feedback node; and a second circuit portion for changing said fixed current to said feedback node in response to at least one of said values selected via said program;

said control transistor having an emitter, collector, and base; and said second circuit portion including:

groups of resistors, with each group having a first end and a second end, with the first end of each said group of resistors coupled to a node between said control resistor and said emitter; and a selection means for each of said groups of resistors coupled to the associated second end of the associated group of resistors and said controller to ground the second end of the group of resistors in response to the selection of an associated value stored in said memory.

3. The apparatus as claimed in claim 2 in which each said selection means includes a three state gate.

4. The apparatus as claimed in claim 3 in which said first circuit portion also includes a temperature compensating circuit coupled to the base of said control transistor.

5. An apparatus for use with a liquid crystal display (LCD) comprising:

a circuit for controlling a contrast of the LCD comprising:

a controller including a memory for storing values to control the contrast of said LCD and also including a program for executing instructions associated with controlling the contrast of said LCD;

a switching regulator having an output voltage for connection to the LCD and also having a feedback node therein;

a first circuit portion for providing a fixed current to said feedback node; and a second circuit portion for changing said fixed current to said feedback node in response to at least one of said values selected via said program;

said first circuit portion including a first control resistor, and also including a plurality of groups of resistors, with each group of resistors having one of said values associated therewith; and each said group of resistors being effectively coupled in parallel to said first control resistor in response to the selection of the associated value via said program for changing the current to said feedback node.

6. An apparatus comprising:

a utilization device; and a circuit for providing stepped negative voltages to said utilization device, said circuit comprising:

a controller including a memory for storing values to control the stepped negative voltages provided to said utilization device and also including a program for executing instructions associated with providing said stepped negative voltages to said utilization device;

a switching regulator having an output for providing said stepped negative voltages to the utilization device, with said switching regulator also having a feedback node therein;

a first circuit portion for providing a fixed current to said feedback node to provide a first of said stepped negative voltages at said output of said switching regulator; and a second circuit portion for changing said fixed current to said feedback node in response to at least one of said values selected via said program to provide another of said stepped negative voltages at the output of the switching regulator;

said first circuit portion including a first control resistor, and also including a plurality of groups of resistors, with each group of resistors having one of said values associated therewith; and each said group of resistors being effectively coupled in parallel to said first control resistor in response to the selection of the associated value via said program for changing the current to said feedback node.

* * * * *